US009487329B2

(12) United States Patent
Balazs et al.

(10) Patent No.: US 9,487,329 B2
(45) Date of Patent: Nov. 8, 2016

(54) SLEEVE PACK ASSEMBLY WITH LATCHING MECHANISM

(71) Applicant: ORBIS Corporation, Oconomowoc, WI (US)

(72) Inventors: Donald J. Balazs, Oconomowoc, WI (US); Scott J. Buss, Watertown, WI (US)

(73) Assignee: ORBIS Corporation, Oconomowoc, WI (US)

( * ) Notice: Subject to any disclaimer, the term of this patent is extended or adjusted under 35 U.S.C. 154(b) by 236 days.

(21) Appl. No.: 14/039,040

(22) Filed: Sep. 27, 2013

(65) Prior Publication Data

US 2014/0284247 A1 Sep. 25, 2014

Related U.S. Application Data

(60) Provisional application No. 61/804,882, filed on Mar. 25, 2013.

(51) Int. Cl.
*B65D 19/00* (2006.01)
*B65D 19/06* (2006.01)

(52) U.S. Cl.
CPC ..... *B65D 19/06* (2013.01); *B65D 2519/00034* (2013.01); *B65D 2519/00069* (2013.01); *B65D 2519/0091* (2013.01); *B65D 2519/00338* (2013.01); *B65D 2519/00407* (2013.01); *B65D 2519/00497* (2013.01); *B65D 2519/00502* (2013.01); *B65D 2519/00592* (2013.01); *B65D 2519/00597* (2013.01); *B65D 2519/00661* (2013.01); *B65D 2519/00711* (2013.01); *B65D 2519/00975* (2013.01)

(58) Field of Classification Search
CPC ..... B65D 2519/00502; B65D 19/06; B65D 19/12; B65D 2519/00661
See application file for complete search history.

(56) References Cited

U.S. PATENT DOCUMENTS 3,374,915 A * 3/1968 Verhein et al. ..... 220/4.28
3,926,412 A * 12/1975 Beretta ..... 256/46
3,966,072 A * 6/1976 Gonzales et al. ..... 220/7
4,221,296 A * 9/1980 Fell et al. ..... 206/600
4,626,155 A * 12/1986 Hlinsky et al. ..... 410/82
4,720,013 A 1/1988 Nichols et al.

(Continued)

FOREIGN PATENT DOCUMENTS

DE 102005031526 4/2007
EP 2256051 A1 * 12/2010

(Continued)

OTHER PUBLICATIONS

Extended European Search Report for EP Application No. EP 14150885.3 mailed Jul. 3, 2014 (7 pages).

(Continued)

*Primary Examiner* — Nathan J Newhouse
*Assistant Examiner* — Jennifer N Zettl
(74) *Attorney, Agent, or Firm* — Nixon Peabody LLP

(57) ABSTRACT

A sleeve pack assembly with a latching mechanism that can be engaged by an operator's foot when in an upright position. The latching mechanism includes a front facing engagement panel. The engagement panel is connected to a spring element in the pallet and to one or more projections or prongs for engaging and/or disengaging apertures in at least one side of a sleeve.

20 Claims, 9 Drawing Sheets

(56) References Cited

U.S. PATENT DOCUMENTS

| | | | | | |
|---|---|---|---|---|---|
| 4,746,053 | A | | 5/1988 | Nichols | |
| 4,798,290 | A | | 1/1989 | Bradford | |
| 4,966,280 | A | | 10/1990 | Bradford | |
| 5,017,260 | A | | 5/1991 | Bardford | |
| 5,037,027 | A | | 8/1991 | Nichols | |
| 5,109,985 | A | * | 5/1992 | Rose | 206/600 |
| 5,295,632 | A | | 3/1994 | Zink et al. | |
| 5,462,221 | A | | 10/1995 | Zink et al. | |
| 5,522,539 | A | | 6/1996 | Bazany | |
| 5,538,178 | A | * | 7/1996 | Zink et al. | 229/117.01 |
| 5,597,084 | A | * | 1/1997 | Parasin | 220/4.28 |
| 5,597,113 | A | | 1/1997 | Bradford | |
| 5,638,983 | A | * | 6/1997 | Bazany | 220/642 |
| 5,722,328 | A | * | 3/1998 | Darby | 108/55.1 |
| 5,725,118 | A | * | 3/1998 | Slager et al. | 220/4.28 |
| 5,725,119 | A | | 3/1998 | Bradford et al. | |
| 5,732,876 | A | | 3/1998 | Bradford | |
| 5,788,146 | A | | 8/1998 | Bradford et al. | |
| 5,813,566 | A | | 9/1998 | Bradford et al. | |
| 5,862,917 | A | * | 1/1999 | Noble et al. | 206/600 |
| 5,908,135 | A | * | 6/1999 | Bradford et al. | 220/673 |
| 6,024,223 | A | * | 2/2000 | Ritter | 206/600 |
| 6,305,601 | B1 | | 10/2001 | Bazany et al. | |
| 6,349,877 | B1 | | 2/2002 | Bradford | |
| D454,692 | S | | 3/2002 | Bublitz | |
| D455,266 | S | | 4/2002 | Bradford | |
| 6,460,724 | B1 | | 10/2002 | Bradford | |
| 6,540,096 | B1 | | 4/2003 | Bazany et al. | |
| 6,547,127 | B2 | | 4/2003 | Bradford et al. | |
| 6,564,993 | B1 | | 5/2003 | Wassink | |
| 6,592,025 | B2 | | 7/2003 | Bazany et al. | |
| 6,619,540 | B1 | | 9/2003 | Bazany | |
| 6,902,061 | B1 | * | 6/2005 | Elstone | 206/600 |
| 7,083,369 | B2 | | 8/2006 | Nyeboer | |
| 7,258,232 | B2 | | 8/2007 | Bradford et al. | |
| 7,322,485 | B2 | | 1/2008 | Bradford et al. | |
| 7,344,043 | B2 | | 3/2008 | Nyeboer | |
| 7,344,044 | B2 | | 3/2008 | Bradford et al. | |
| 7,360,663 | B2 | | 4/2008 | Vroon | |
| 7,380,358 | B2 | | 6/2008 | Bazany et al. | |
| 7,410,094 | B2 | | 8/2008 | Bos | |
| 7,428,975 | B2 | | 9/2008 | Bradford | |
| 7,503,462 | B2 | | 3/2009 | Vroon | |
| 7,540,390 | B2 | | 6/2009 | Bublitz et al. | |
| 7,556,170 | B2 | | 7/2009 | Vroon | |
| 7,644,830 | B2 | | 1/2010 | Vroon | |
| 7,644,831 | B2 | | 1/2010 | Vroon | |
| 7,654,408 | B2 | | 2/2010 | Bazany | |
| 7,748,559 | B2 | | 7/2010 | Bradford | |
| 7,748,803 | B2 | | 7/2010 | Bazany et al. | |
| 7,762,422 | B2 | | 7/2010 | Dobrinski | |
| 7,774,919 | B2 | | 8/2010 | Bublitz et al. | |
| 7,775,419 | B2 | | 8/2010 | Bale | |
| 7,878,345 | B2 | | 2/2011 | Tourlamain | |
| 7,878,362 | B2 | | 2/2011 | Nyeboer | |
| 8,061,549 | B2 | | 11/2011 | Nyeboer et al. | |
| 8,079,490 | B2 | | 12/2011 | Nyeboer et al. | |
| 8,100,282 | B2 | | 1/2012 | Nyeboer et al. | |
| 8,100,283 | B2 | | 1/2012 | Nyeboer et al. | |
| 8,112,859 | B2 | | 2/2012 | Vroon | |
| 8,146,224 | B1 | | 4/2012 | Vroon | |
| 8,523,004 | B2 | | 9/2013 | Vroon | |

FOREIGN PATENT DOCUMENTS

| | | | | |
|---|---|---|---|---|
| FR | 2126521 | A5 | | 10/1972 |
| GB | 2440327 | A | * | 1/2008 |
| JP | 2008-308194 | A | | 12/2008 |
| JP | 2009-107703 | A | | 5/2009 |
| WO | 2006132613 | A1 | | 12/2006 |

OTHER PUBLICATIONS

European Patent Office, Examination Report for EP 14150885.3 mailed Nov. 9, 2015 (4 pages).

* cited by examiner

SLEEVE PACK ASSEMBLY WITH LATCHING MECHANISM

CROSS-REFERENCE TO RELATED APPLICATIONS

The present invention claims the benefit of U.S. Provisional Patent Application No. 61/804,882, filed Mar. 25, 2013, the contents of which are incorporated herein by reference.

FEDERALLY SPONSORED RESEARCH OR DEVELOPMENT

N/A

FIELD OF THE INVENTION

The present invention generally relates to a latching mechanism having a forward facing engagement panel for use with a sleeve pack assembly, and more particularly to a latching mechanism for a sleeve pack assembly having an engagement panel that can be operated by a user's foot.

BACKGROUND OF THE INVENTION

Returnable bulk containers come in two general classifications, sleeve packs and knock downs. A sleeve pack includes a pallet, a sleeve and a top cap. To assemble and disassemble a sleeve pack today there are two options to retain (i.e., lock) the bottom portion of the sleeve to the pallet and the top portion of the sleeve to the top cap. These include (1) a passive interference fit, and (2) an active latching mechanism.

The passive interference fit lock generally creates a weak engagement and/or is difficult to assemble, and can damage the sleeve. The active latching mechanisms available today require the operator to bend over or kneel and reach under the pallet to engage the lock.

The present invention provides the desirable aspects of both designs, allowing for an easy passive latch assembly without the need to bend and reach, while providing a strong "lock" between the components. It also provides for active disengaging without the need to bend and reach.

Additional aspects of the present invention are set forth herein.

SUMMARY OF THE INVENTION

The present invention provides a spring loaded latching mechanism incorporated into a sleeve pack assembly. The latching mechanism is automatically engaged during set-up of the assembly (without requiring additional steps from the operator). The latching mechanism can be easily disengaged with a push or kick of the foot of the operator and does not require the operator to bend, kneel or reach for the mechanism.

In accordance with one embodiment, the latching mechanism can be formed as a one piece, plastic spring which is particularly useful for instances requiring food safety. Other embodiments can be formed of multiple components and can include other materials, such as a steel spring.

The latching mechanism can be implemented on any type of sleeve pack regardless of the number of sides in the sleeve. For example, the latching mechanism can be used for a sleeve pack with a sleeve having three sides, or for one having four or more sides such as an octagon shaped sleeve with eight sides. Moreover the latching mechanism could be implemented with a sleeve sidewall having curvature, such as a cylindrical shaped sleeve with a circular cross-section.

In accordance with another embodiment, a sleeve pack assembly is provided with a latching mechanism that can be operated by a user in an upright position. The sleeve pack assembly comprises a sleeve having a first side, a second side, and a third side. Additionally, the sleeve can include a fourth side for a rectangular shape, or have more than four sides (such as an octagon shaped sleeve with eight sides). The sleeve is configured to have a first bottom opening and a second top opening when opened. When not in use, the sleeve can be folded and/or collapsed to provide for more efficient transport. At least one of the sides has a first aperture proximate a bottom portion of the at least one side.

The assembly also includes a pallet having a plurality of feet forming a base of the assembly. The pallet includes a channel proximate a periphery for receiving a bottom edge portion of each side of the sleeve.

The assembly also includes a latch mechanism having a spring element and a first prong coupled to the first spring element. The first prong is aligned with the first aperture of the sleeve such that the first prong extends through the first aperture when the sleeve is positioned in the channel. The latch mechanism also includes an engagement panel positioned on an outer surface of one of the plurality of feet, such as a center foot. Activation of the engagement panel (e.g., by an operator's foot) pushes back the spring element and the first prong, and disengages the first prong from the first aperture.

The assembly can be configured so that the sleeve includes a second aperture proximate the bottom portion of the at least one side spaced from the first aperture, and the latch mechanism includes a second prong aligned with the second aperture of the sleeve. The second prong is positioned to extend through the second aperture when the sleeve is positioned in the channel.

The first prong can include an inclined upper surface. This acts as a camming surface and moves the prong out of the way when installing the sleeve into the channel. Likewise, the second prong (and any additional prongs) can have an inclined upper surface.

The foot housing the latch mechanism can include a first window aligned with the first prong (and a second window aligned with the second prong) to allow for visual inspection of the mechanism. This enables an operator to determine that the sleeve is secured to the pallet.

The latch mechanism can be formed as a single plastic piece. Alternatively, the latch mechanism can include a plurality of components. In this alternative embodiment, the latch mechanism can include a steel spring element.

The assembly can also include a top cap. The top cap can be configured to include a latch mechanism.

The assembly can also include a first stop for preventing inward movement of the engagement panel past a set point. Similarly, the assembly can also include a second stop. The stops can include a flap that interacts with a boss in the pallet. The assembly can also include an opening or slot aligned with the boss to act as a guide for the latching mechanism.

In accordance with another embodiment of the invention, a sleeve pack assembly is provided comprising a collapsible sleeve having a first side, a second side, and a third side. Again, the sleeve can have a fourth side or more than four sides. The sleeve has a bottom opening and a top opening, a bottom portion of at least one of the sides has a first aperture. The assembly includes a pallet having a latching mechanism for securing the sleeve to the pallet. The latching mechanism includes a forward facing engagement panel in a side of the pallet, and an engagement member aligned to engage the aperture of the sleeve. The pallet can include a plurality of feet wherein the latching mechanism is positioned in one of the feet.

The latching mechanism further includes a spring element. The spring element can be a molded-in part integral with the engagement panel and engagement member. Alternatively, the spring element can be a separate component.

The sleeve pack assembly can include a second aperture in the sleeve spaced from the first aperture. The engagement member can then include a first prong aligned with the first aperture and a second prong aligned with the second aperture.

The latching mechanism can include a stop to prevent the engagement panel from being depressed beyond a set distance. The stop can be a flap that cooperates with structure in the pallet, such as a boss.

Additionally, the latching mechanism can include a guide slot that cooperates with structure in the pallet. The structure can be the boss.

Further aspects of the invention are disclosed in the Figures, and are described herein.

BRIEF DESCRIPTION OF THE DRAWINGS

To understand the present invention, it will now be described by way of example, with reference to the accompanying figures in which.

DETAILED DESCRIPTION

While this invention is susceptible of embodiments in many different forms, there is shown in the Figures, and will herein be described in detail preferred embodiments of the invention with the understanding that the present disclosure is to be considered as an exemplification of the principles of the invention and is not intended to limit the broad aspect of the invention to the embodiments illustrated.

Figure 1:
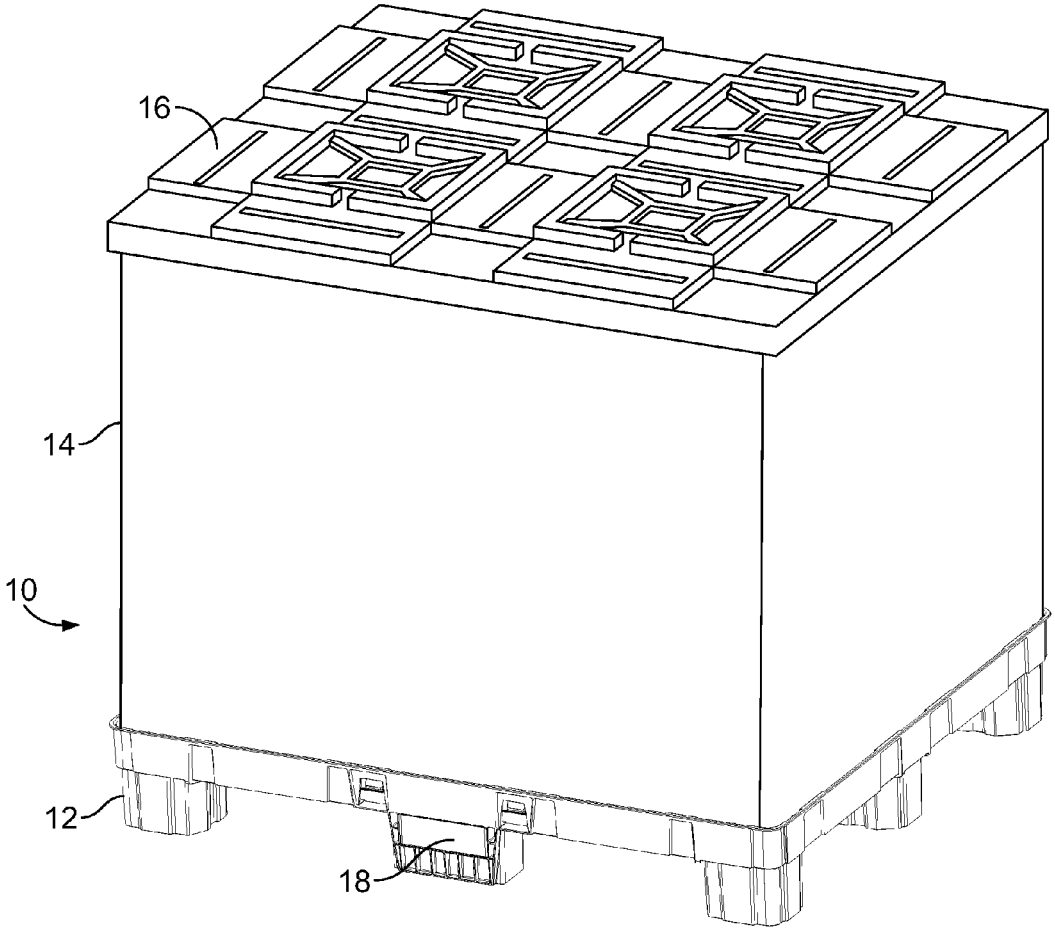
FIG. 1 is a perspective view of a set-up sleeve pack assembly incorporating a latching mechanism in accordance with the present invention.
Figure 2A:
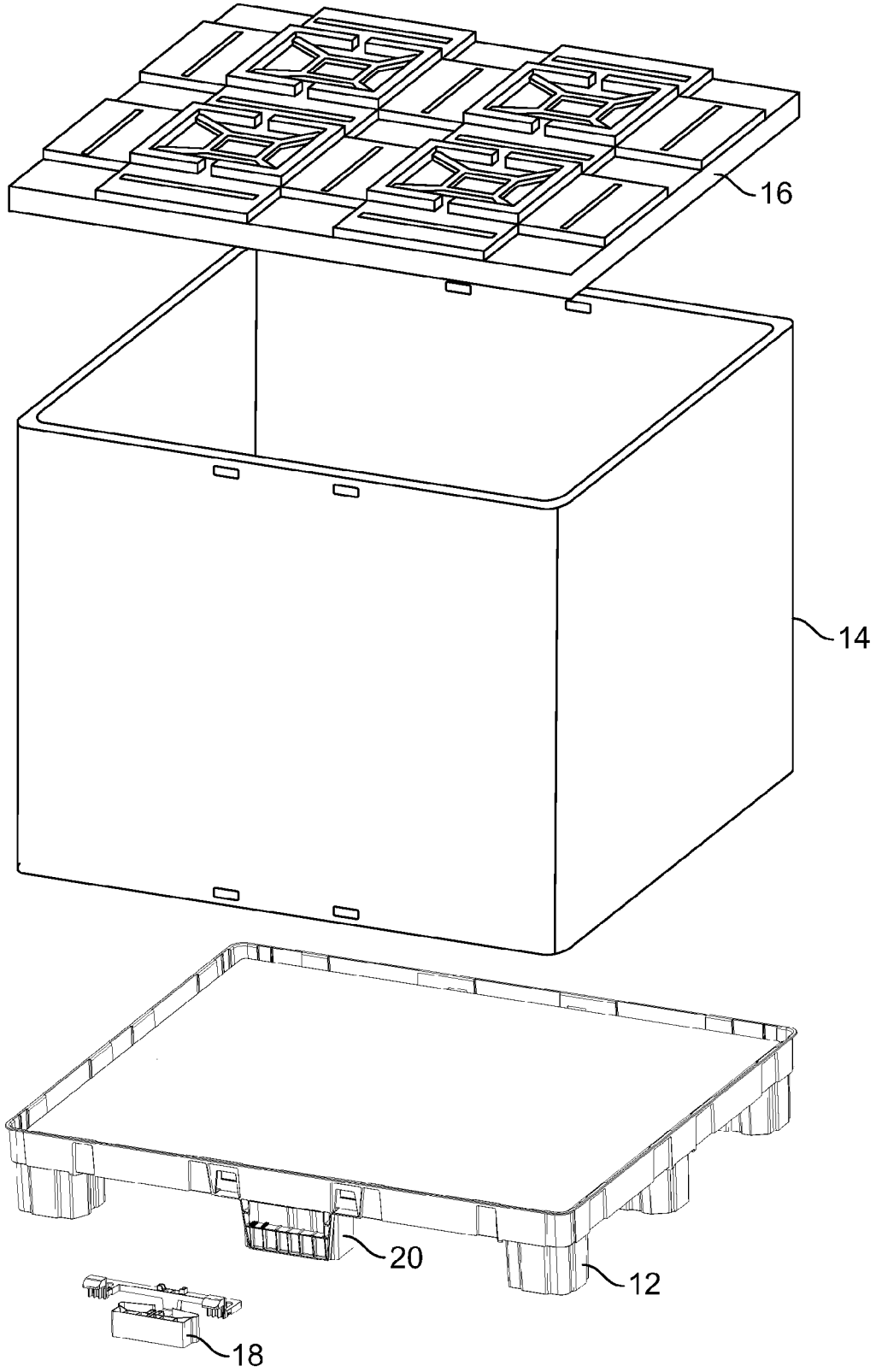
FIGS. 2A and 2B are exploded perspective views of the sleeve pack assembly of FIG. 1 in a set up and collapsed position, respectively.
Figure 2B:
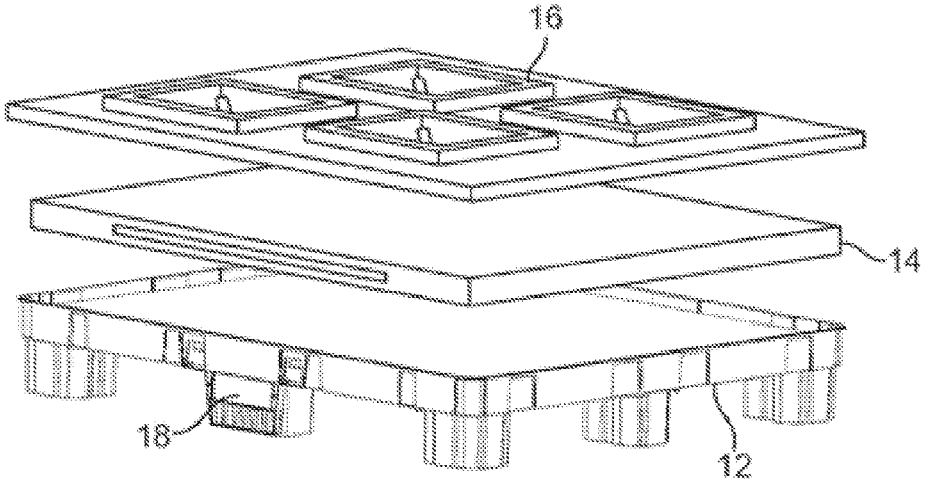

As illustrated in FIGS. 1 and 2A and 2B, a sleeve pack assembly 10 includes a pallet 12, a foldable/collapsible sleeve 14 and a top cap 16. The sleeve pack assembly 10 also includes a latching mechanism 18 located in a center foot 20 of the pallet 12. The latching mechanism 18 is for securing the sleeve 14 to the pallet 12.

The sleeve 14 includes four sides and an open top and open bottom. The sleeve can be a single piece, or can be formed from two or more pieces, such as one commonly referred to as a C-sleeve. As illustrated in FIGS. 2A and 2B, the sleeve opens to form the side walls of the pack, and folds for more compact shipment when empty.

Figure 3:
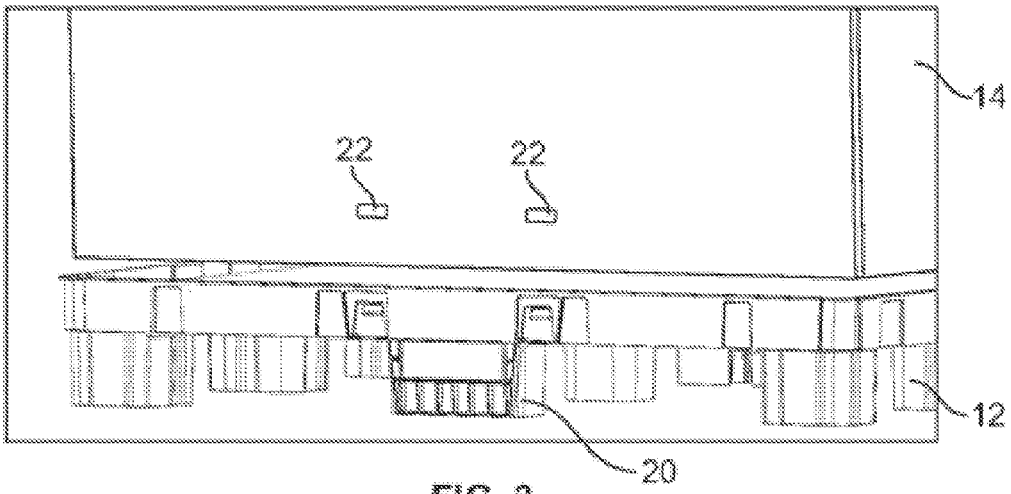
FIG. 3 is a partially exploded perspective view of a bottom portion of a sleeve pack assembly.
Figure 4:
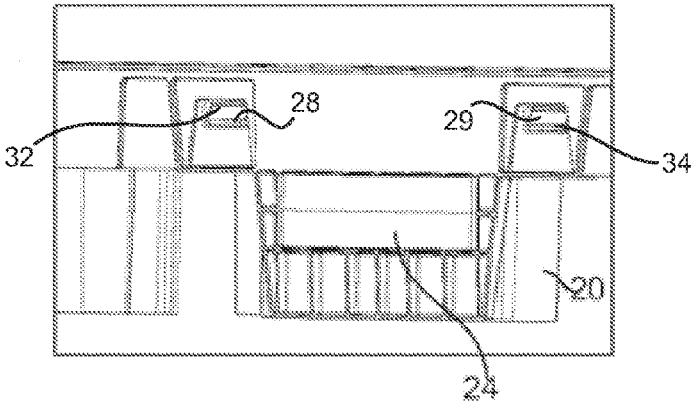
FIG. 4 is a perspective view of a latch mechanism of an assembled sleeve pack assembly.

As shown in FIG. 3, the sleeve is provided with two apertures 22 located proximate a bottom portion of at least one side wall (all of the side walls could include the apertures so that no special alignment of the sleeve to the pallet is necessary, or if additional latching mechanisms are provided on other sides of the pallet). The apertures 22 are spaced to align with components of the latching mechanism 18 which extend through the apertures 22 when the sleeve pack assembly 10 is set up as illustrated in FIG. 4. The sleeve 14 is designed to fold or collapse when not set-up as part of the assembly 10.

Figure 5:
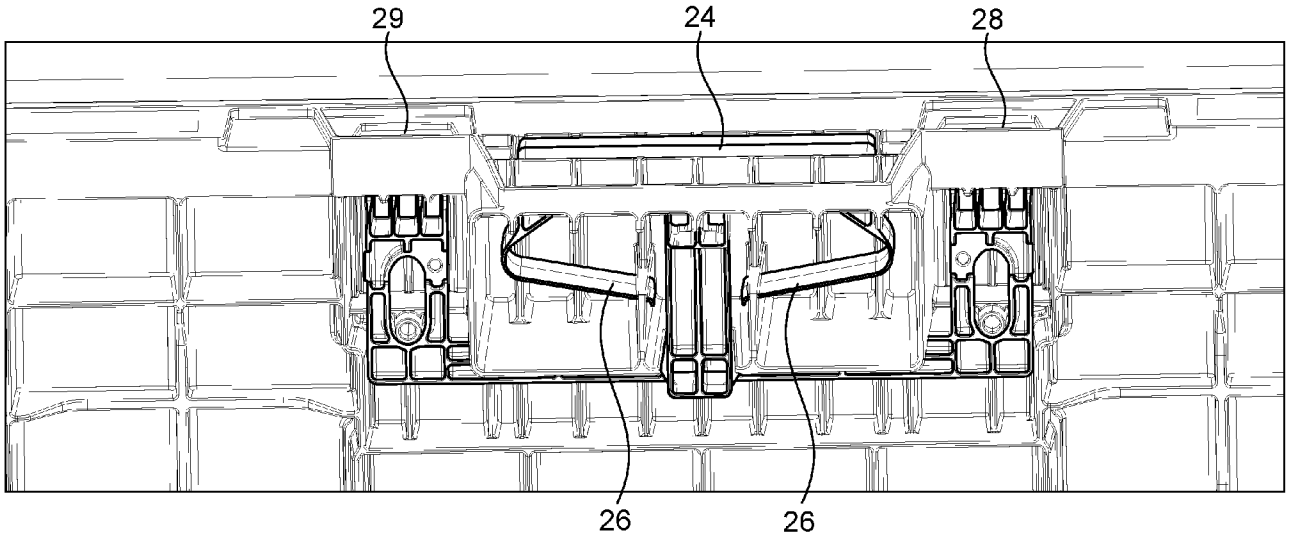
FIG. 5 is a bottom view of a latching mechanism of an assembled sleeve pack assembly.

As illustrated in the bottom view of FIG. 5, the latching mechanism 18 includes an engagement panel or kick panel 24 (i.e., "kick," because it can be operated by a user's foot) that is flush with an opening in a forward facing side of a foot 20 of the pallet 12. The kick panel 24 is connected to molded-in spring elements 26 (here, flexible bent pieces of plastic) as well as engagement members in the form of a first prong 28 and a second prong 29 (more fully shown in FIG. 9). As discussed below, the engagement members cooperate with the apertures to secure the sleeve in place.

Figure 6:
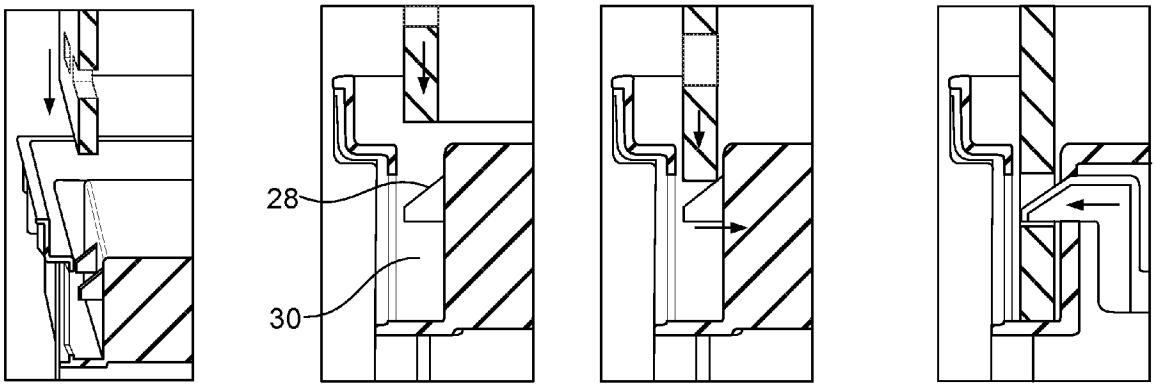
FIG. 6 is a progressive series of cross-sectional views of a sleeve engaging a latching mechanism.

As shown in cross-section in FIG. 6, the pallet 12 includes a trough or channel 30 proximate the side edges of the pallet for receiving a bottom portion of each side of the sleeve 14. Referring to FIG. 6, the prongs 28, 29 are provided with inclined upper surfaces 32. As the bottom edge of the sleeve 14 is lowered into the channel 30, it contacts the upper surface of the prongs 32 and forces the prongs 28, 29 to slide backwards into the pallet 12. The prongs 28 are aligned with the apertures 22 of the sleeve and will spring back through the apertures 22 when the sleeve is lowered sufficiently into the channel 30, thus securing the sleeve 14 to the pallet 12. Accordingly, the latching mechanism is activated automatically during the set-up.

Figure 7:
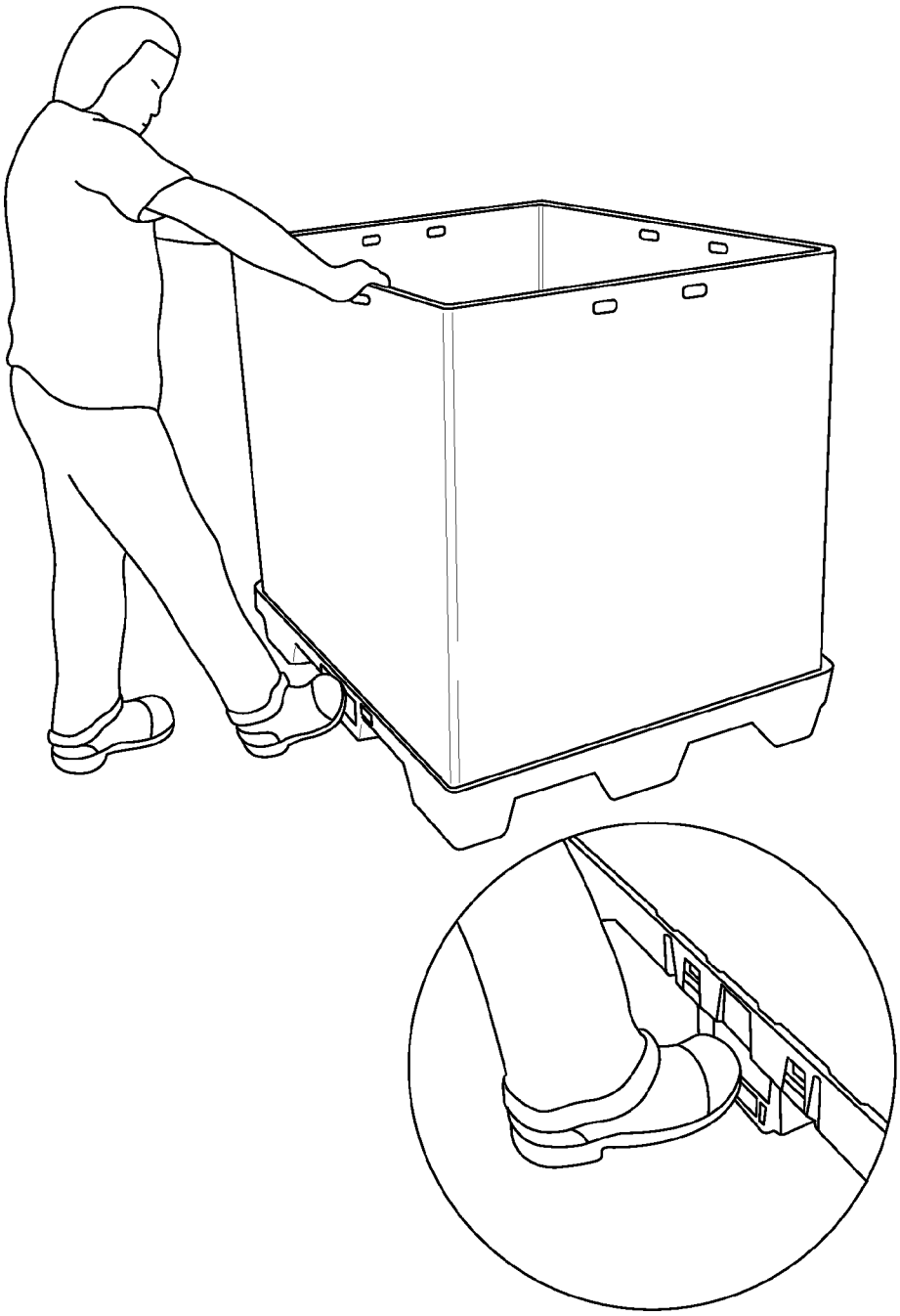
FIG. 7 is a perspective of a user operating a latching mechanism of the present invention.
Figure 8:
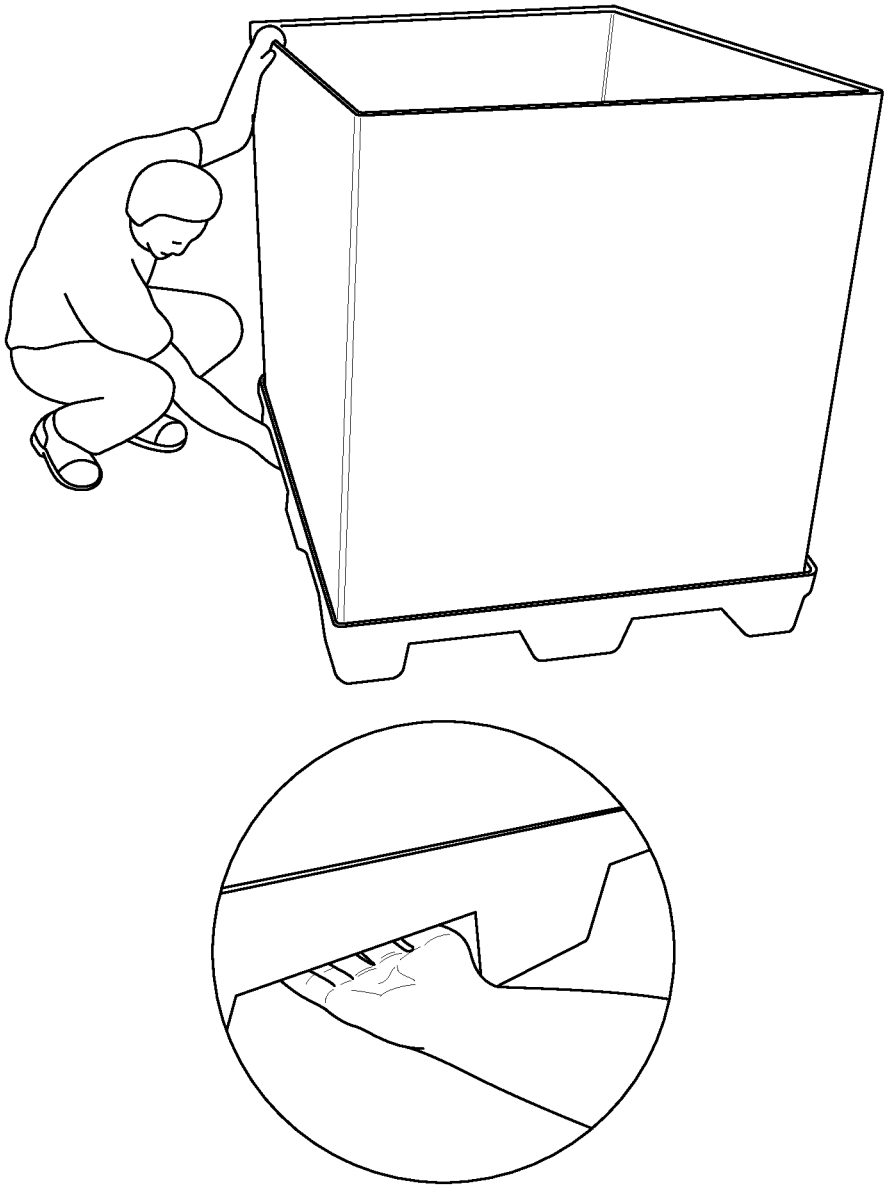
FIG. 8 is a perspective view of a user operating prior latching mechanisms.

As illustrated in FIG. 7, to remove the sleeve, pressure is applied to the kick-panel 24, pushing back the spring elements 26 and the attached prongs 28 until the prongs disengage the apertures 22 in the sleeve 14. The sleeve 14 can then be lifted out of the trough 30 in the pallet 12 by the operator. In the past, the operator would have to kneel and reach under the pallet to disengage the latch as shown in FIG. 8.

Figure 9:
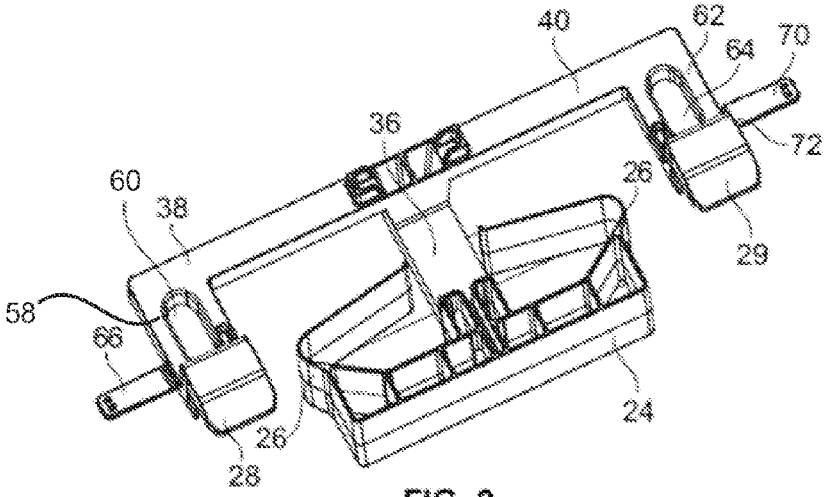
FIG. 9 is a perspective view of a latching mechanism of the present invention prior to placement in a pallet.

The latching mechanism 18 is shown by itself in FIG. 9. In this embodiment, the kick-panel 24 is connected directly to the spring elements 26—one extending from each side of the kick-panel 24. While molded-in spring elements 26 are shown, other types of springs (whether molded-in or as separate components) or mechanisms (e.g., a hydraulic system) can be used.

As shown in FIG. 4, the pallet above the center foot 20 is provided with a first aperture or window 32 aligned with the first prong 28 near a first side of the center foot and a second aperture or window 34 aligned with the second prong 29 near a second side of the center foot. The windows 32 allow a user to visually inspect the latch mechanism and ensure the prongs have captured and secured the sleeve 14 to the pallet 12.

The kick-panel 24 is connected to a central shaft 36 which, in turn, is connected to a first arm 38 and a second arm 40. The first and second arms 38, 40 are connected to the first and second prongs 28, 29, respectively.

Figure 10:
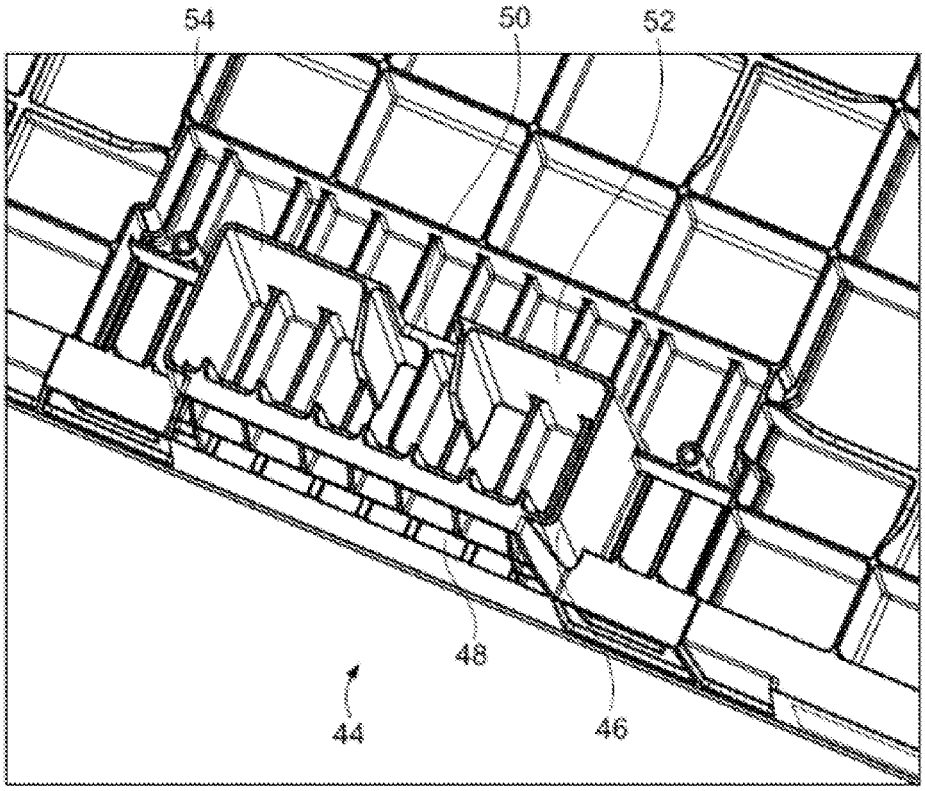
FIG. 10 is a partial bottom perspective view of the portion of the pallet designed to hold the latching mechanism shown in FIG. 9.

The latching mechanism 18 fits into a holder 42 (shown without the latching mechanism 18 in FIG. 10) formed on the lower side of the pallet 12 (preferably in one of the feet 42, such as a central foot). The holder 44 includes a first rectangular spring portion 44 which contains the kick-panel 24 and the spring elements 26. The spring portion 46 includes an opening 48 in the front for access to the kick-panel 24 and a smaller opening 50 in the back for the central shaft 36. The spring portion 46 includes a first back wall portion 52 and a second back wall portion 54.

The sleeve 14 can be removed by pushing or pressing in the kick panel 24 (this can be done with the user's foot). When the kick-panel 24 is pressed inward the spring elements 26 compress against the back wall portions 52, 54 (this also occurs when the sleeve 14 contacts the inclined surfaces of the prongs 28, 29 and forces the prongs backward). Additionally, the central shaft 36 moves the first and second arms 38, 40 backward which in turn, moves the first and second prongs 28, 29 back out of the apertures in the sleeve 14. The sleeve 14 can then be lifted out of the channel 30.

When pressure is released from the kick-panel 24, the spring elements 26 push the kick-panel 24 back in position flush with the outer wall of the foot 42. In this manner, the latching mechanism 18 is biased in a closed position (the open position is when the prongs 28, 29 are pushed back to allow for removal of the sleeve 14).

As shown in FIG. 9, the first prong 28 is connected to the first arm 38 by a first positioning segment 58 having a central opening or slot 60. Similarly, the second prong 29 is connected to the second arm 40 by a second positioning segment 62 having a central opening or slot 64. The central openings or slots 60, 64 have a generally oval shape. As noted below, the openings or slots 60, 64 cooperate with structure in the pallet 12 to act as a guide for the latching mechanism 18.

Figure 11:
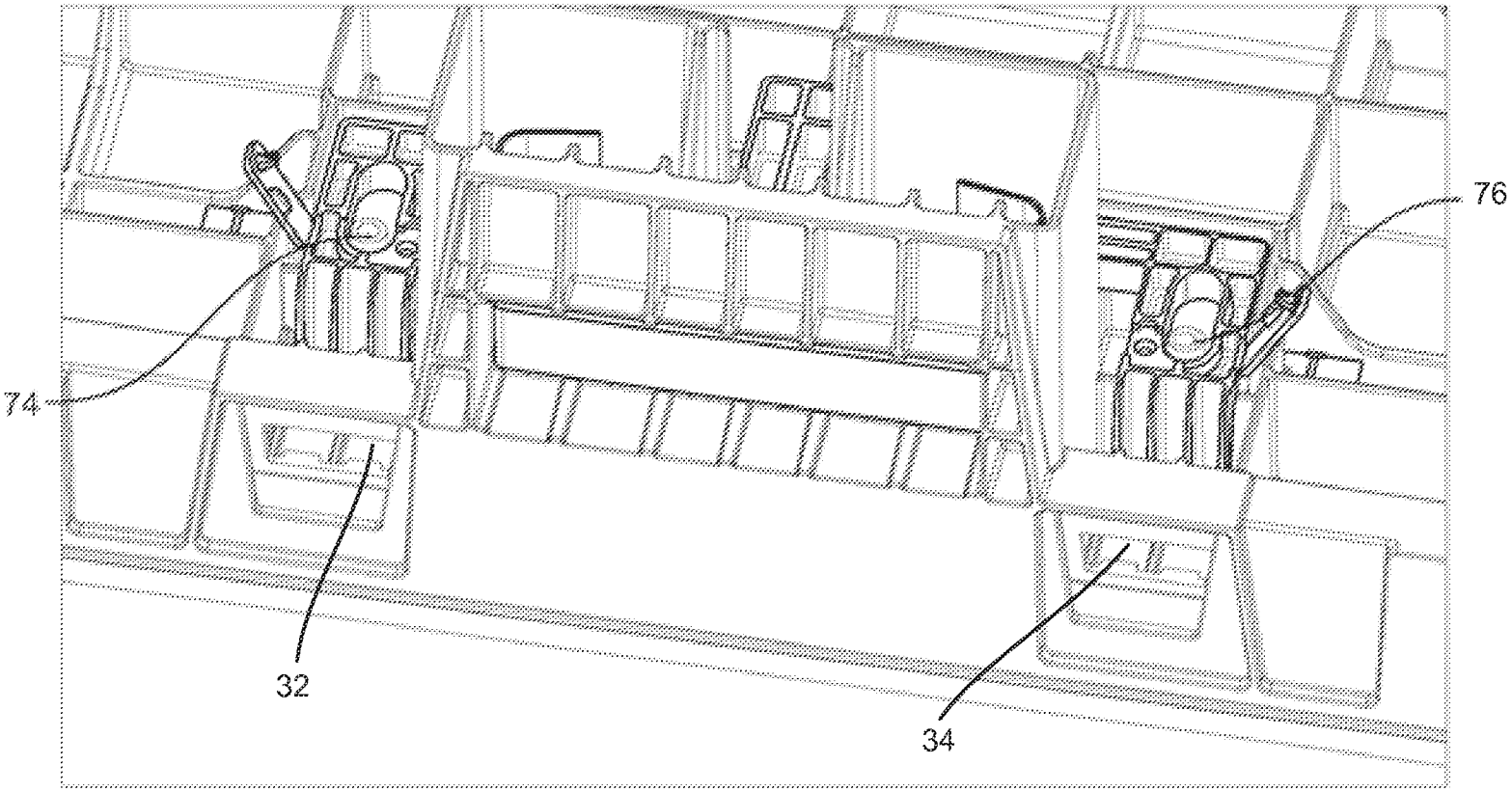
FIG. 11 is a partial bottom perspective view of the latching mechanism in a pallet with stop flaps partially folded; and, FIGS. 12A and 12B are partial bottom perspective views of the latching mechanism in a closed position and a depressed position, respectively.
Figure 12A:
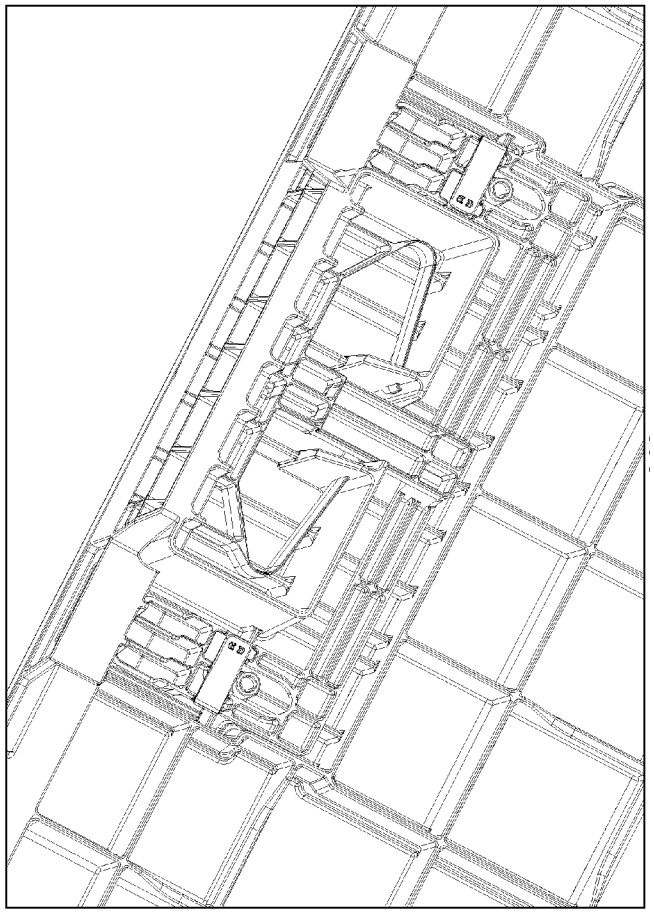

As also shown in FIG. 9, the latching mechanism 18 also includes a first stop flap 66 connected by a living hinge 68 to the first positioning segment 58 proximate the first prong 28, and a second stop flap 70 connected by a living hinge 72 to the second positioning segment 62 proximate the second prong 29. As illustrated in FIGS. 11 and 12A and B, the stop flaps 66, 70 are folded over and snapped into place (when the latching mechanism 18 is inserted into the holder 42).

As illustrated in FIG. 11, the latching mechanism 18 is placed in the holder 44 so that a first boss 74 is positioned in the central opening 60 of the first positioning segment 58, and a second boss 76 is positioned in the central opening 64 of the second positioning segment 62. The bosses 74, 76 and openings 60, 64 function as guides during movement of the latching mechanism.

Figure 12B:
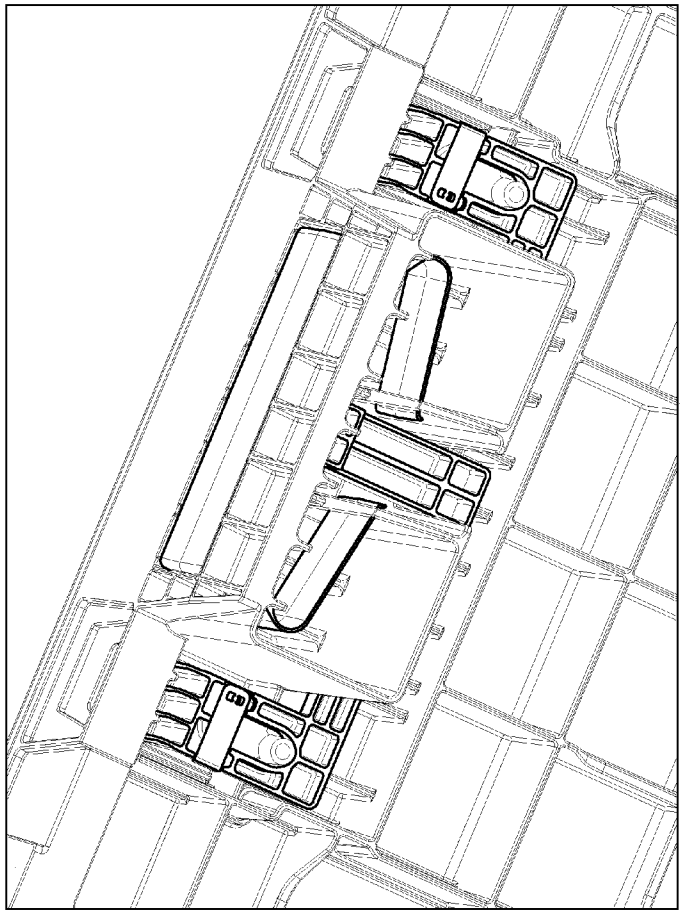

FIG. 11 also shows the stop flaps 66, 70 partially folded over into place. FIGS. 12A and 12B show the latching mechanism 18 in a closed position (with the kick-panel 24 flush with the outer surface of the foot) and a depressed (i.e., pushed-in) position, respectively. As noted in FIG. 12B, the flaps 66, 70 and bosses 74, 76 stop movement of the latching mechanism 18 inward and prevent it from moving too far.

In one alternative embodiment, a latching mechanism as shown in the pallet 12, could be incorporated into a top cap or other similar structure applied to the top of a sleeve pack. In another alternative embodiment, the latch mechanism can be located in a corner foot of the pallet 12 or another portion of the pallet (e.g., between feet, or a side portion if the pallet does not include feet).

While two apertures and two prongs are shown in the Figures, the assembly could be formed with only one aperture and one prong, one long aperture or slot for two or more prongs, or two or more apertures and two or more prongs. Additionally, the assembly can include more than one latching mechanism (e.g., mechanisms on opposing sides of the pallet).

Many modifications and variations of the present invention are possible in light of the above teachings. It is, therefore, to be understood within the scope of the appended claims the invention may be protected otherwise than as specifically described.

We claim:

1. A sleeve pack assembly comprising:

a sleeve having a first side, a second side, and a third side, the sleeve having a first bottom opening and a second top opening, at least one of the sides having a first aperture proximate a bottom portion of the at least one side;

a pallet having a plurality of feet forming a base of the assembly, the pallet including a channel for receiving a bottom edge portion of each side of the sleeve; and, a latch mechanism having a first spring element, a first prong coupled to the first spring element, the first prong being aligned with the first aperture of the sleeve wherein the first prong extends through the first aperture when the sleeve is positioned in the channel, and a separate engagement panel positioned on an outer surface of one of the plurality of feet connected to the first prong wherein activation of the engagement panel disengages the first prong from the first aperture for release of the sleeve.

2. The assembly of claim 1 wherein the sleeve includes a second aperture proximate the bottom portion of the at least one side spaced from the first aperture, and the latch mechanism includes a second prong aligned with the second aperture of the sleeve wherein the second prong extends through the second aperture when the sleeve is positioned in the channel.

3. The assembly of claim 1 wherein the first prong includes an inclined upper surface.

4. The assembly of claim 2 wherein a portion of the latch mechanism is positioned in a center foot of the pallet.

5. The assembly of claim 4 wherein the pallet includes a first window on a first side of the center foot aligned with the first prong and a second window on a second side of the center foot aligned with the second prong to enable an operator to visually determine that the sleeve is secured to the pallet.

6. The assembly of claim 1 wherein the latch mechanism is a single plastic piece.

7. The assembly of claim 1 wherein the latch mechanism includes a steel spring element.

8. The assembly of claim 1 wherein the latch mechanism includes a plurality of components.

9. The assembly of claim 1 further comprising a top cap.

10. The assembly of claim 1 wherein the spring element is biased toward a closed position and activation of the engagement panel compresses the spring element to move the first prong.

11. The assembly of claim 1 further comprising a first stop for preventing inward movement of the engagement panel past a set point.

12. The assembly of claim 11 wherein the first stop includes a flap that interacts with a boss in the pallet.

13. The assembly of claim 1 wherein the latch mechanism includes an opening aligned with a boss in the pallet, the opening and boss acting as a guide for the latch mechanism.

14. A sleeve pack assembly comprising:

a collapsible sleeve having a first side, a second side, and a third side, the sleeve having a bottom opening and a top opening, a bottom portion of at least one of the sides having a first aperture; and, a pallet having a latching mechanism for securing the sleeve to the pallet, the latching mechanism including a forward facing engagement panel sized for activation by a foot in a side of the pallet, and an engagement member connected to the engagement panel aligned to engage the aperture of the sleeve, and wherein the sleeve includes a second aperture spaced from the first aperture and the engagement member includes a first prong aligned with the first aperture and a second prong aligned with the second aperture.

15. The sleeve pack assembly of claim 14 wherein the latching mechanism further includes a spring element.

16. The sleeve pack assembly of claim 15 wherein the spring element, the engagement panel and engagement member are a single piece of plastic.

17. The sleeve pack assembly of claim 14 wherein the latching mechanism includes a stop to prevent the engagement panel from being depressed beyond a set distance.

18. The sleeve pack assembly of claim 14 wherein the latching mechanism includes a guide slot that cooperates with structure in the pallet.

19. The sleeve pack assembly of claim 14 wherein the pallet includes a plurality of legs.

20. A sleeve pack assembly comprising:

a collapsible sleeve having a first side, a second side, and a third side, the sleeve having a bottom opening and a top opening, a bottom portion of at least one of the sides having a first aperture; and, a pallet having a latching mechanism for securing the sleeve to the pallet, the latching mechanism including a forward facing engagement panel in a side of the pallet, and an engagement member aligned to engage the aperture of the sleeve, wherein the sleeve includes a second aperture spaced from the first aperture and the engagement member includes a first prong aligned with the first aperture and a second prong aligned with the second aperture.

* * * * *